US008414414B2

(12) United States Patent
Viramontez

(10) Patent No.: US 8,414,414 B2
(45) Date of Patent: Apr. 9, 2013

(54) WEIGHT SHIFTING DEVICE(S) FOR ATHLETIC TRAINING

(76) Inventor: Walter Viramontez, Santee, CA (US)

( * ) Notice: Subject to any disclaimer, the term of this patent is extended or adjusted under 35 U.S.C. 154(b) by 21 days.

(21) Appl. No.: 12/977,810

(22) Filed: Dec. 23, 2010

(65) Prior Publication Data

US 2012/0165137 A1 Jun. 28, 2012

(51) Int. Cl.
*A63B 69/36* (2006.01)

(52) U.S. Cl. ..... 473/270; 473/278

(58) Field of Classification Search ..... 473/218, 473/266, 269, 270, 271, 278, 279, 422
See application file for complete search history.

(56) References Cited

U.S. PATENT DOCUMENTS 3,122,846 A * 3/1964 Trent ..... 434/252
3,352,559 A 11/1967 Larsen
3,372,930 A 3/1968 Sertich
3,384,377 A 5/1968 Stipp
3,639,923 A 2/1972 Stewart
3,669,494 A * 6/1972 Lohmeyer ..... 297/440.14
3,698,721 A 10/1972 Stewart
3,758,118 A 9/1973 Willcox
3,955,821 A 5/1976 Spedding
4,037,847 A 7/1977 Lorang
4,088,325 A 5/1978 Sutton
4,132,404 A 1/1979 Wilson
4,146,231 A 3/1979 Merkle et al.
4,194,735 A 3/1980 Wilson
4,522,392 A 6/1985 Torii
4,895,372 A 1/1990 Muller
4,950,033 A * 8/1990 Anderson ..... 297/461
4,962,933 A 10/1990 Awazu et al.
4,998,720 A 3/1991 Kim
5,000,457 A 3/1991 Brown
5,069,445 A 12/1991 Mai
5,076,580 A 12/1991 Lang
5,150,902 A * 9/1992 Heisler ..... 473/269
5,163,686 A 11/1992 Bergman
5,197,739 A 3/1993 Johnson, III
5,318,290 A 6/1994 Sawyer
5,330,176 A 7/1994 Cagney, Jr.
5,354,247 A * 10/1994 Wilkinson ..... 482/52
5,358,251 A 10/1994 Ashton
D360,767 S * 8/1995 Fish et al. ..... D6/349
5,591,090 A 1/1997 Kauffman, Jr.
5,743,831 A 4/1998 Jakich
5,749,555 A * 5/1998 Albrecht ..... 248/346.01
5,897,474 A 4/1999 Romero
5,916,036 A 6/1999 Hamilton
5,976,026 A 11/1999 Erb
6,001,026 A 12/1999 Breneman
6,402,633 B1 6/2002 Hsiung et al.
6,422,872 B1 7/2002 Outlaw
6,500,078 B1 12/2002 Williams et al.
6,723,004 B1 4/2004 Florian
D491,246 S 6/2004 Walsh et al.
(Continued)

*Primary Examiner* — NiNi Legesse
(74) *Attorney, Agent, or Firm* — Lewis Kohn & Fitzwilliam LLP; Timothy W. Fitzwilliam

(57) ABSTRACT

A swing training system for improving muscle memory and weight transfer during a swinging motion. The swing training system comprises a first device and a second device for a user to stand upon raised flat summits on each device placed approximately shoulder width apart. The user then performs a swinging motion corresponding to a sport such as golf, tennis or baseball while maintaining balance on the devices. Such balance will be committed to muscle memory and will allow for better swings when in actual play.

7 Claims, 5 Drawing Sheets

U.S. PATENT DOCUMENTS

| | | | | |
|---|---|---|---|---|
| 6,790,166 | B2 | 9/2004 | Broudy | |
| 6,869,371 | B2 | 3/2005 | Perry | |
| D533,247 | S | 12/2006 | Weeks | |
| D537,141 | S * | 2/2007 | Peterson | D21/791 |
| 7,261,377 | B2 * | 8/2007 | Ehud | 297/283.1 |
| 7,335,117 | B2 | 2/2008 | Reason-Kerkhoff | |
| 7,468,010 | B2 | 12/2008 | Du Brock | |
| 7,677,988 | B2 | 3/2010 | McMillan | |
| 7,775,914 | B1 | 8/2010 | Greene | |
| 2003/0022726 | A1 | 1/2003 | Mindlin | |
| 2004/0082399 | A1 | 4/2004 | Shioda | |
| 2006/0205528 | A1 * | 9/2006 | McMillan | 473/279 |
| 2008/0188331 | A1 | 8/2008 | Shimizu et al. | |
| 2008/0318703 | A1 | 12/2008 | Mooney | |
| 2009/0163325 | A1 | 6/2009 | Piaget et al. | |

* cited by examiner

WEIGHT SHIFTING DEVICE(S) FOR ATHLETIC TRAINING

BACKGROUND OF THE INVENTION

1. Field of the Invention

The present invention pertains generally to devices and methods for training a well balanced swing technique. More particularly, the present invention, in a preferred embodiment relates to devices for improving transfer of weight in a swinging motion for baseball/softball, tennis or golfing.

2. Description of the Prior Art

Heretofore, many inventions have been introduced to assist in developing proper stabilization while transferring weight in the swinging motion, particularly in golf and baseball applications. One such example was proposed by Shimizu, et al., U.S. Pat. App. Pub. No. 2008/0188331, entitled "Swing Training Device."

According to Shimizu and his co-inventors, in sports that require a swinging motion, i.e. golf, baseball, softball, cricket, tennis, racquetball, and squash, it is understood that the art or science of an optimal swing requires balance. Balance throughout the swing ensures minimal eye movement and proper body mechanics prior to and during the moment of impact with the ball. With regard to baseball, it's has been said that the hardest thing in sports is to hit a moving round ball with a round bat. Without a balanced swing, consistently hitting a baseball is nearly impossible.

When swinging a bat, club etc., during a game or match, it is imperative that prior to impact the player is completely focused on making contact with the ball without worrying about swing mechanics or body balance. Using a training aid to train the body and in turn muscle memory to swing consistently with balance will help athletes during the pressures of a game or competition to maximize their chances for success of consistently hitting the ball.

Other related inventions promoting a balanced swing or muscle memory include: "Swing Training Device for Sports," U.S. Pat. No. 7,335,117 to Reason-Kerkhoff, another entitled "Apparatus and Method for Training A Baseball Player to Hit A Baseball," U.S. Pat. No. 7,468,010 to Du Brock, another entitled "Measurement and Analysis of Foot Related Forces During a Golf Swing," U.S. Pat. App. Pub. No. 2008/0318703 by Mooney, another entitled "Training Device for Golfers," U.S. Pat. No. 7,677,988 to McMillan, and another entitled "Leg Positioning and Training Device for Golfers" to Perry, another entitled "Weight Shift Training Apparatus for Golfers," U.S. Pat. No. 6,723,004 to Florain, another entitled "Golf Practice Foot Stand," U.S. Pat. App. Pub. No. 2004/0082399 to Shioda, and another entitled "Balance and Coordination Teaching Method," U.S. Pat. No. 6,790,166 to Broudy, and another entitled "Method and Apparatus for Golf Instruction," U.S. Pat. App. Pub. No. 2003/0022726 to Mindlin, and another entitled "Batting Practice Balance Platform" U.S. Pat. No. 6,422,872 to Outlaw, and another entitled "Golf Training Device," U.S. Pat. No. 6,001,026 to Breneman, and another entitled "Weight Shift Monitor for Golfers," U.S. Pat. No. 5,916,036 to Hamilton, and another entitled "Baseball Swing Training Apparatus," U.S. Pat. No. 5,318,290 to Sawyer, and another entitled "Golf Training Device," U.S. Pat. No. 5,000,457 to Brown, and another entitled "Batting Stance and Stride Practice Apparatus," U.S. Pat. No. 4,194,735 to Wilson, and another entitled "Golf Swing Practice Platform," U.S. Pat. No. 4,146,231 to Merkle et al., and another entitled "Golf Swing Training Device," U.S. Pat. No. 4,088,325 to Sutton, and another entitled "Golf Swing Training Apparatus," U.S. Pat. No. 4,037,847 to Lorang, and another entitled "Golfer's Stance Training Device," U.S. Pat. No. 3,955,821 to Spedding, and another entitled "Golf Practice Platform," U.S. Pat. No. 3,639,923 to Stewart, and another entitled "Golf Stance Guide," U.S. Pat. No. 3,384,377, to Stipp, and another entitled "Foot Trainer with Adjustable Rotation and Friction Means," U.S. Pat. No. 3,372,930 to Sertich, and another entitled "Golf Swing Training Device," U.S. Pat. No. 3,352,559 to Larsen.

While these proposals may be beneficial for their respective purposes, a need however still remains to provide a device that can be manufactured inexpensively, as many prior art devices have moving parts or electronics. An additional need that remains unresolved is to provide a device that can be easily stored.

In light of the above, it is an object of the present invention to provide a new balance apparatus that can be manufactured by injection molding, for example, and thereby reduce its cost. It is yet further an object of the present invention to provide a balance mechanism with few moving part or electronics, if any to make the invention affordable and accessible to a larger set of sports enthusiasts. It is an additional embodiment of the present invention to provide a design that is additionally attractive to the consumer due to easy storage.

BRIEF SUMMARY OF THE INVENTION

The present invention specifically addresses and alleviates the above mentioned deficiencies associated with the prior art. More particularly, the present invention comprises a swing training system for improving muscle memory and weight transfer during a swinging motion comprising a first device and second device each having a main portion with a flat summit for placement of a user's foot and a base portion providing stability for the device. The flat summits provide traction for the user's feet by having artificial grass or a traction pad. A user would stand on both devices while practicing a swinging motion such as with a golf club or baseball bat. The user must then attempt to remain balanced on the devices while performing the swinging motion by shifting their weight accordingly.

The devices create raised platforms requiring the user to properly maintain balance to target proper muscle groups to achieve proper swing balance. The targeting of specific muscle groups would allow for strengthening of the muscles and commit the actions to muscle memory. Having the proper swing balance technique committed to muscle memory would translate to performing a better swing motion while actually playing a corresponding sport.

These, as well as other advantages of the present invention, will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE PREFERRED EMBODIMENTS

Figure 1A:
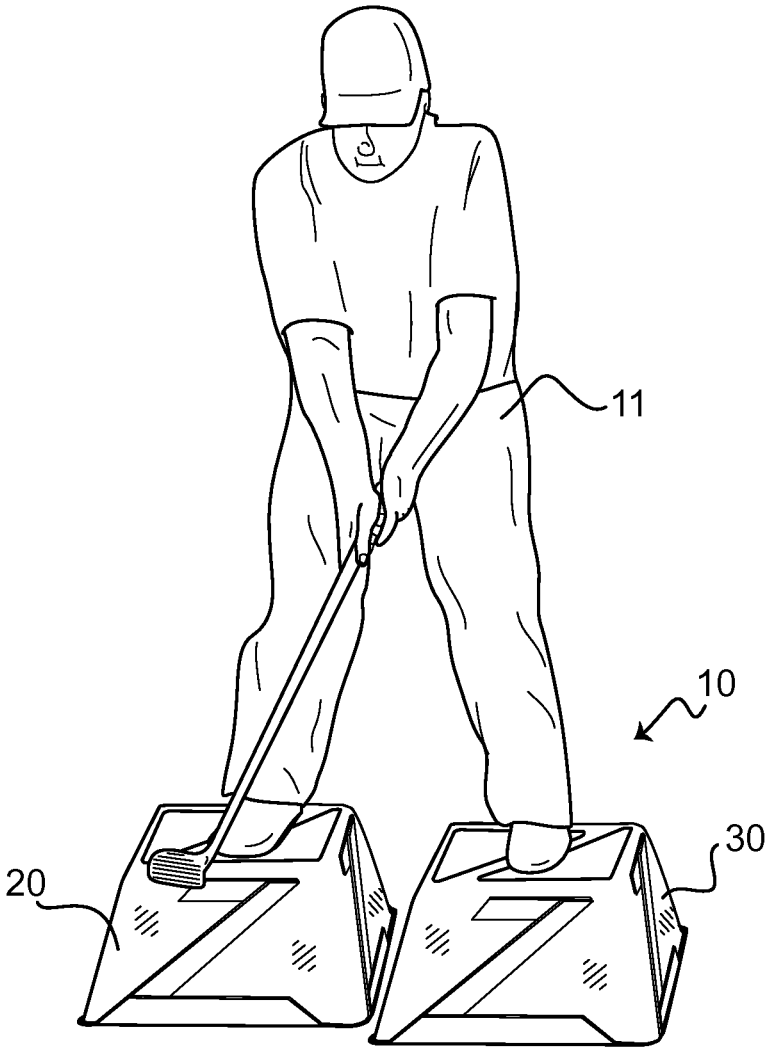
FIG. 1A is a front view of the swing training system in use by a user.

With reference to FIG. 1A, a user 11 stands on top of the first device 20 and the second device 30. Devices 20 and 30 are placed separately approximately shoulder-width apart on the ground. The distance between the first device 20 and the second device 30 is optimal for proper balance of the user 11.

Figure 1B:
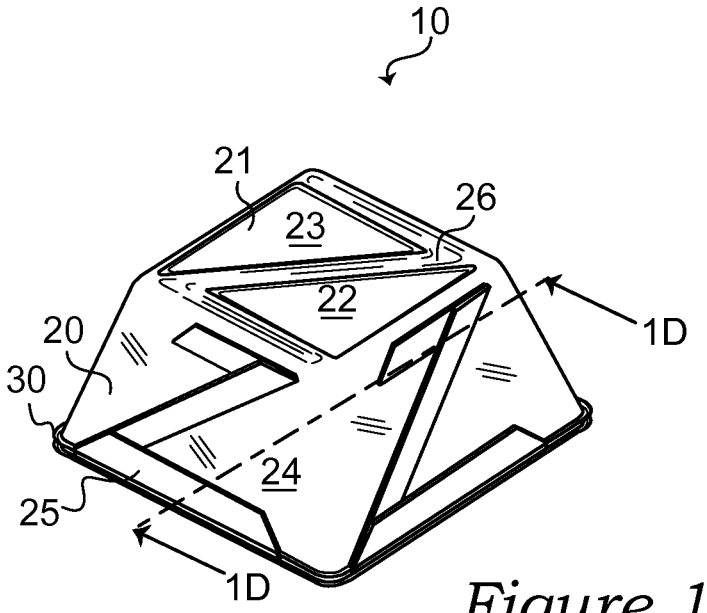
FIG. 1B is an isometric view of a device used in the swing training system.
Figure 1C:
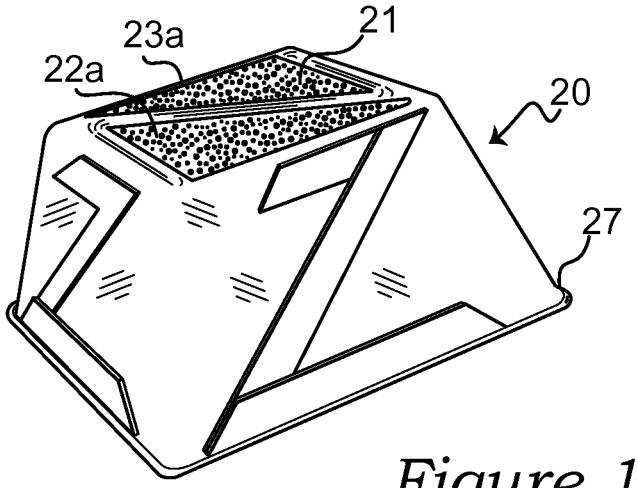
FIG. 1C is another isometric view of an alternate embodiment of a device used in the swing training system.

With reference to FIG. 1B, a swing training system 10 for improving muscle memory and weight transfer during a swinging motion comprises of a first device 20 and a second device 30 wherein the first device 20 and second device 30 are substantially similar. The first device 20 comprises a first main portion 29 with a flat summit 21 for placement of a foot 41 of a user during the swinging motion. A first base portion 27 is used to stabilize the first device 20 in which it protrudes outwardly from the first main portion 29. The main portion 29 is formed like a frustum of a pyramid cut off by a parallel plane 21 which is also the flat summit 21. With further reference to FIG. 1C, one embodiment of the device 20 may have a first artificial grass surface 22*a* and a second artificial grass surface 23*a*.

Figure 1D:
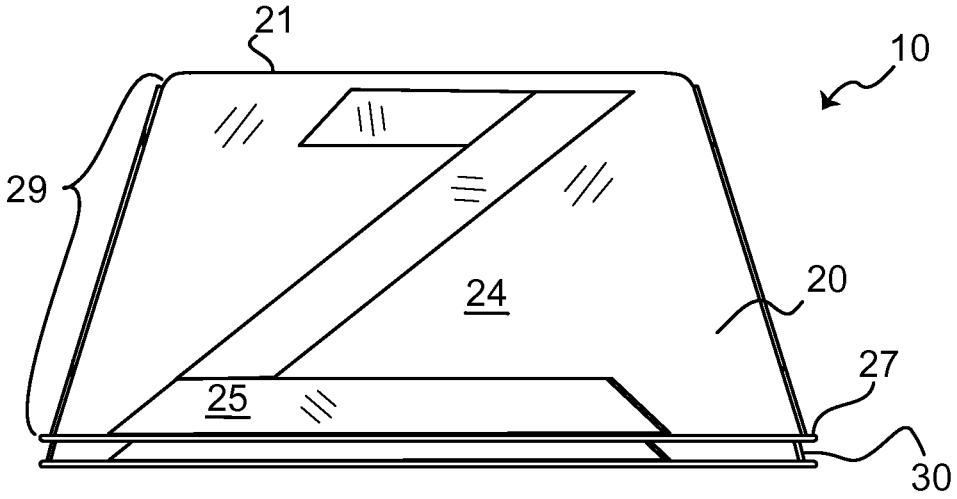
FIG. 1D is a side view of one device stacked upon a second device.

With reference to FIG. 1D, the first device 20 is stackable upon the second device 30 in the same foot print and substantially covers the second device 20 when stacked. The second device 30 is physically separable from the first device 20. Each device has a lateral side 24 having a trapezoidal shape and a raised logo 25 contributing to brand awareness of the system. In one embodiment, the logo 25 may be a 'Z' character. The preferred height of the device 20 is 6 inches.

Figure 1E:
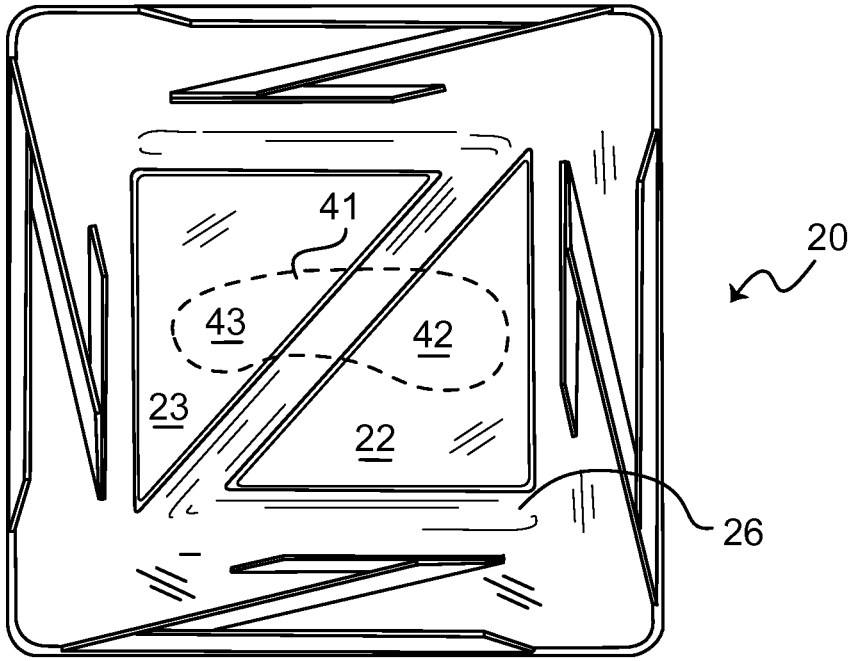
FIG. 1E is a top plan view of the device depicted in FIG. 1B.

With reference to FIG. 1E, a channel 26 having a shape of a logo is carved out of the flat summit 21. The flat summit 21 has a first surface 22 for a ball 42 of a user's foot 41 and a second surface 23 for a heel 43 of a user's foot 41. The first main portion 29 has a preferred width of 14 inches, and the flat summit 21 has a preferred width of 12 inches.

Figure 2A:
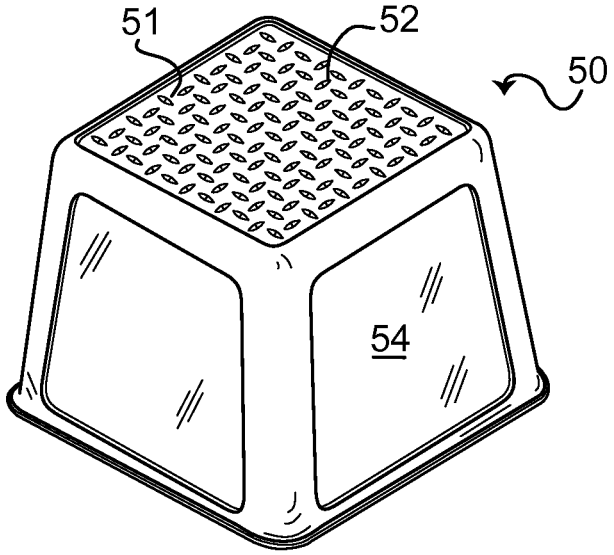
FIG. 2A is an isometric view of a second alternate embodiment of a device used in the swing training system using a traction pad.
Figure 2B:
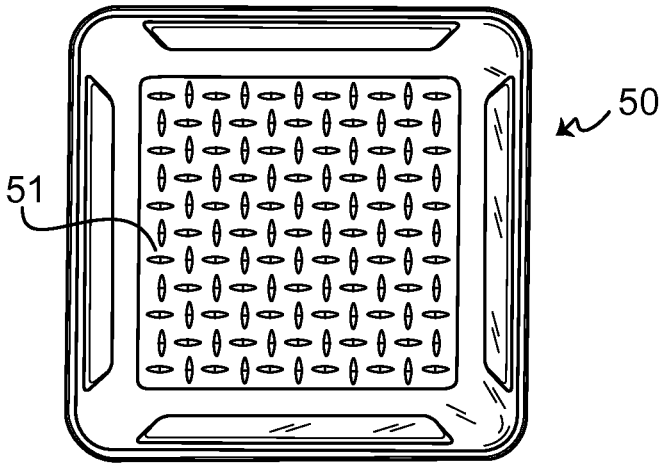
FIG. 2B is a top plan view of the device depicted in FIG. 2A.

With reference to FIGS. 2A and 2B, in an alternate embodiment, the device 50 may have a flat summit 51 and a lateral side 54. The flat summit 51 has a traction surface 52 for providing a grip for a user's foot 41.

Figure 2C:
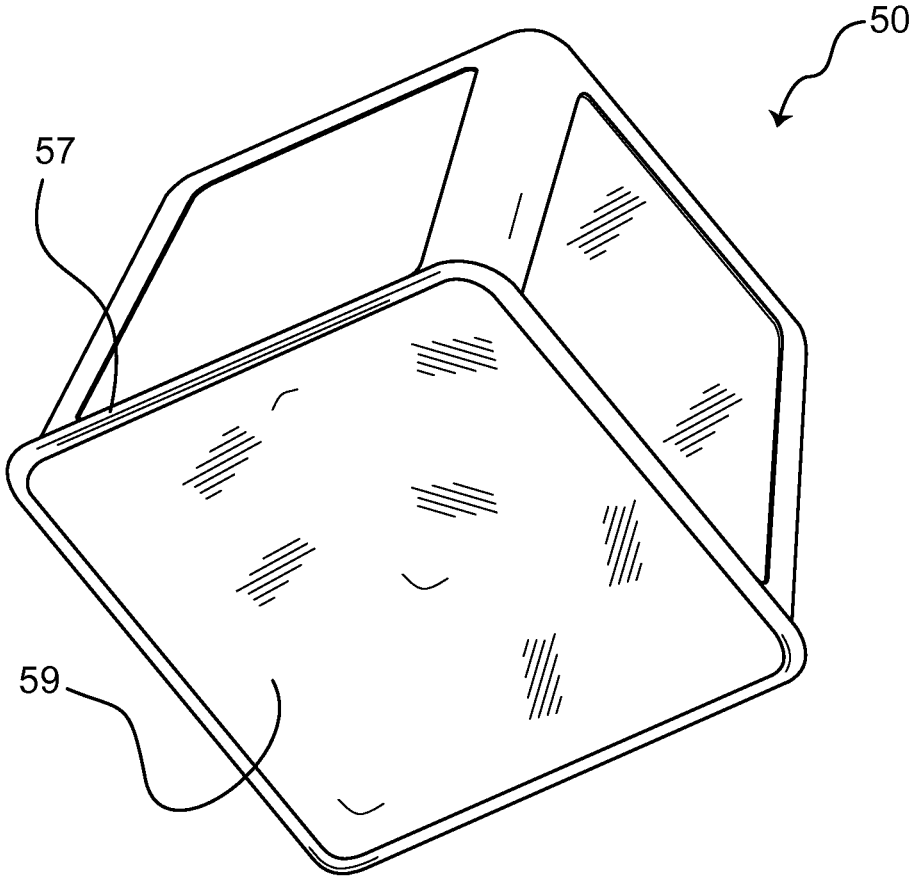
FIG. 2C is an isometric view from a vantage point below the device.

With reference to FIG. 2C, in an underside view of the device 50, cavity 59 is open and allows the device 50 to be stacked upon another in the same footprint and substantially covering a second device 50.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Weight Shifting Devices for Athletic Training as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A swing training system for improving muscle memory and weight transfer during a swinging motion comprising:

a plurality of devices, each device comprising:

a main portion having a flat summit and forming a height of the device, the flat summit for placement of a foot of a user during the swinging motion; and a base portion for stabilizing the device;

wherein the devices are stackable in the same footprint and wherein the device substantially covers another device when stacked;

further wherein the flat summit comprising:

a first artificial grass surface corresponding to a ball of a user's foot; and a second artificial grass surface corresponding to a heel of a user's foot.

2. A swing training system for improving muscle memory and weight transfer during a swinging motion of claim 1, further comprising the base portion protruding outwardly from the main portion, wherein the main portion further comprises a frustum of a pyramid shape, the pyramid cut off by a parallel plane, wherein the flat summit is the parallel plane.

3. The swing training system for improving muscle memory and weight transfer during a swinging motion of claim 1, wherein the flat summits comprise a fraction surface.

4. The swing training system for improving muscle memory and weight transfer during a swinging motion of claim 1, further comprising:

a lateral side having a trapezoidal shape; and a raised logo protruding from the lateral side, the raised logo contributing to brand awareness of the system.

5. The swing training system for improving muscle memory and weight transfer during a swinging motion of claim 4 wherein the logo comprises a "Z" character.

6. The swing training system for improving muscle memory and weight transfer during a swinging motion of claim 1, wherein the flat summit further comprises a channel carved out thereof, the channel having a shape of a logo.

7. The swing training system for improving muscle memory and weight transfer during a swinging motion of claim 1 further comprising:

a main portion width; and a flat summit width, wherein the main portion width is 14 inches, and wherein the flat summit width is 12 inches and wherein the height is 6 inches, and wherein the first main portion width, the flat summit width and the height are chosen to optimally provide stabilization of the first device and further to provide a desired sensation to the user standing on an island further providing optimum weight transfer and muscle memory during the swinging motion.

* * * * *